US011686486B2

(12) United States Patent
Kondo

(10) Patent No.: US 11,686,486 B2
(45) Date of Patent: Jun. 27, 2023

(54) AIR CURTAIN GENERATING DEVICE

(71) Applicant: TRINITY INDUSTRIAL CORPORATION, Toyota (JP)

(72) Inventor: Yasushi Kondo, Okazaki (JP)

(73) Assignee: TRINITY INDUSTRIAL CORPORATION, Toyota (JP)

( * ) Notice: Subject to any disclaimer, the term of this patent is extended or adjusted under 35 U.S.C. 154(b) by 701 days.

(21) Appl. No.: 16/732,550

(22) Filed: Jan. 2, 2020

(65) Prior Publication Data

US 2020/0256570 A1 Aug. 13, 2020

(30) Foreign Application Priority Data

Feb. 12, 2019 (JP) ..... 2019-023048

(51) Int. Cl.
*F24F 9/00* (2006.01)
*F26B 21/00* (2006.01)
*F26B 21/02* (2006.01)

(52) U.S. Cl.
CPC ..... *F24F 9/00* (2013.01); *F26B 21/004* (2013.01); *F24F 2009/007* (2013.01); *F26B 21/02* (2013.01)

(58) Field of Classification Search
CPC ..... F26B 21/004; F26B 21/02; F26B 3/04; F26B 15/12; F26B 21/04; F26B 25/008; F26B 2210/12; F24F 9/00; F24F 2009/007
See application file for complete search history.

(56) References Cited

U.S. PATENT DOCUMENTS 7,565,753 B2 * 7/2009 Christopher ..... B60S 3/002 34/271
2009/0137198 A1 5/2009 Tsubata et al.

FOREIGN PATENT DOCUMENTS

| | | | | |
|---|---|---|---|---|
| CN | 106052361 A | | 10/2016 | |
| CN | 108759270 A | * | 11/2018 | |
| EP | 1094280 A2 | * | 4/2001 | ..... F24F 3/1607 |
| EP | 2 942 577 A1 | | 11/2015 | |
| JP | S4726560 U | | 11/1972 | |
| JP | S50-118364 A | | 9/1975 | |
| JP | S52-53471 U | | 4/1977 | |

(Continued)

OTHER PUBLICATIONS

English translation, Zheng, CN 108759270 A, Nov. 2018 (Year: 2018).*

(Continued)

*Primary Examiner* — Jessica Yuen
(74) *Attorney, Agent, or Firm* — Oliff PLC

(57) ABSTRACT

An air curtain generating device includes: a plurality of pairs of an air jet unit and an air suction unit placed opposite each other on both sides in a lateral direction of an inlet/outlet of a drying chamber, the plurality of the pairs being aligned up and down, the air suction units sucking air ejected from the air jet units to generate an air curtain; a first air guide provided to the air jet units in an upper part of the inlet/outlet to guide air ejected from the air jet units in a direction inclined inward of the drying chamber relative to the lateral direction of the inlet/outlet; and a second air guide provided to the air jet units in a lower part of the inlet/outlet to guide air ejected from the air jet units in a direction inclined outward of the drying chamber relative to the lateral direction.

22 Claims, 14 Drawing Sheets

(56) References Cited

FOREIGN PATENT DOCUMENTS

| | | | | | |
|---|---|---|---|---|---|
| JP | 59-6397 | U | | 1/1984 | |
| JP | S59-4843 | A | | 1/1984 | |
| JP | 60-14542 | U | | 1/1985 | |
| JP | S-61-87573 | U | | 6/1986 | |
| JP | S63-169435 | A | | 7/1988 | |
| JP | 6-32215 | U | | 4/1994 | |
| JP | H08-042897 | A | | 2/1996 | |
| JP | H08-103713 | A | | 4/1996 | |
| JP | 2004-77113 | A | | 3/2004 | |
| JP | 2005-114322 | A | | 4/2005 | |
| JP | 2006-057928 | A | | 3/2006 | |
| JP | 2007-278577 | A | | 10/2007 | |
| JP | 2013-145104 | A | | 7/2013 | |
| JP | 2016-093769 | A | | 5/2016 | |
| JP | 6-32216 | U | | 4/2022 | |
| KR | 10-0819103 | B1 | | 4/2008 | |
| WO | WO-2007117017 | A1 | * | 10/2007 | ..... A01M 1/08 |

OTHER PUBLICATIONS

English translation, Olsen et al., EP 1094280 A2, Apr. 2001 (Year: 2001).*

Oct. 11, 2022 Notice of Reasons for Refusal issued in Japanese Patent Application No. 2019-023048.

Mar. 22, 2023 Decision to Grant a Patent issued in Japanese Patent Application No. 2019-023048.

* cited by examiner

AIR CURTAIN GENERATING DEVICE

BACKGROUND OF THE INVENTION

(1) Field of the Invention

The present disclosure relates to an air curtain generating device.

(2) Description of Related Art

Some of known air curtain generating devices have air jet outlets placed opposite each other in a lateral direction on both sides of an inlet/outlet of a drying chamber (see, for example, Japanese Unexamined Patent Application Publication No. JP 8-42897 A, paragraph [0004]).

SUMMARY OF THE INVENTION

Conventional air curtain generating devices such as the one mentioned above are desired to improve air blocking performance.

An air curtain generating device according to one aspect of the present disclosure made to solve the problem noted above includes: a plurality of pairs of an air jet unit and an air suction unit placed opposite each other on both sides in a lateral direction of an inlet/outlet of a drying chamber, the plurality of the pairs being aligned up and down, the air suction units sucking air ejected from the air jet units to generate an air curtain; a first air guide provided to the air jet units in an upper part of the inlet/outlet to guide air ejected from the air jet units in a direction inclined inward of the drying chamber relative to the lateral direction of the inlet/outlet; and a second air guide provided to the air jet units in a lower part of the inlet/outlet to guide air ejected from the air jet units in a direction inclined outward of the drying chamber relative to the lateral direction of the inlet/outlet.

The "inlet/outlet" of the drying chamber in the present invention may refer to an entrance alone, or an exit alone, or both an entrance and an exit.

DETAILED DESCRIPTION OF PREFERRED EMBODIMENTS

Figure 1:
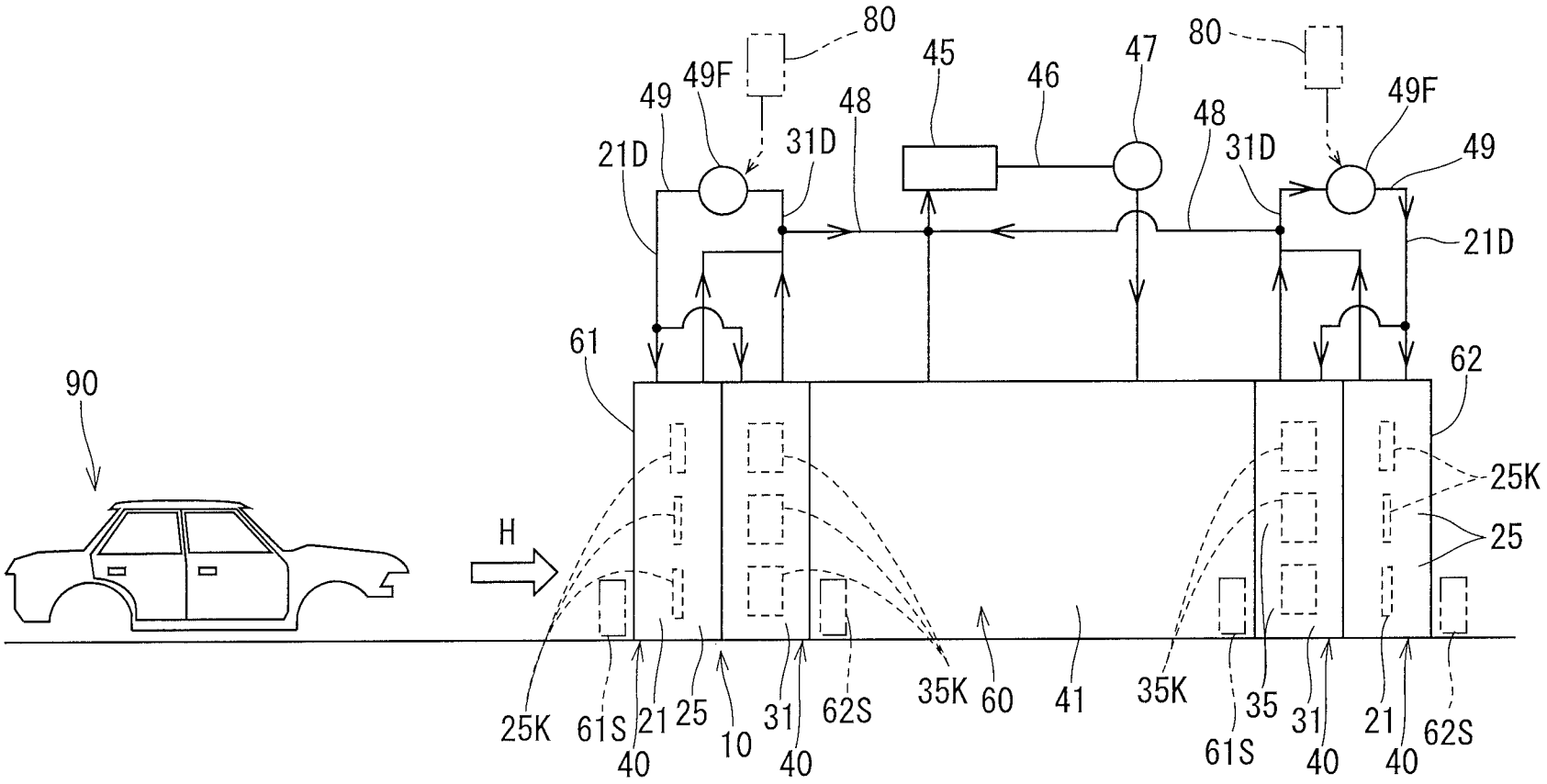
FIG. 1 is a conceptual diagram of a drying chamber equipped with an air curtain generating device according to one embodiment of the present disclosure.
Figure 2:
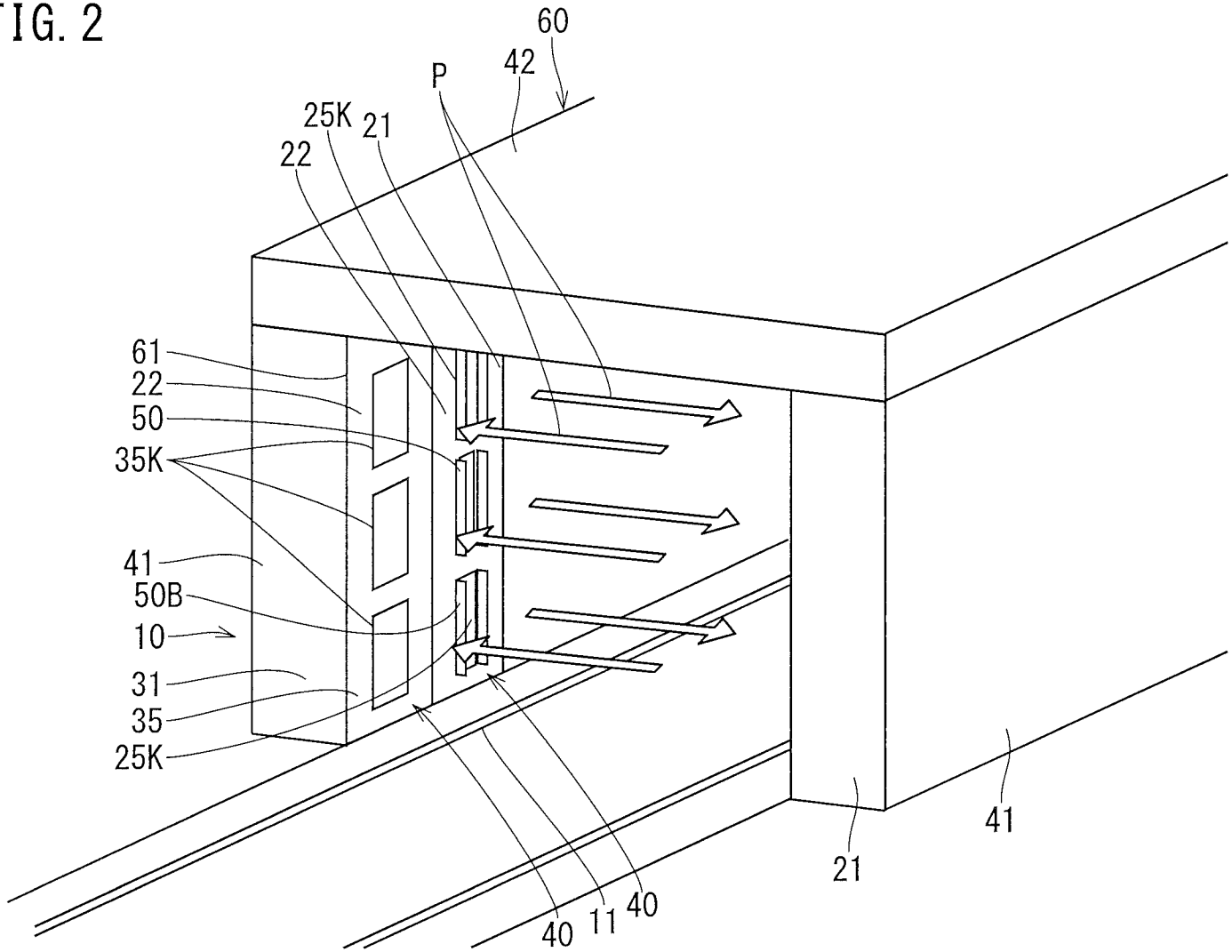
FIG. 2 is a perspective view of the air curtain generating device.

Hereinafter, an air curtain generating device 10 according to one embodiment of the present disclosure will be described with reference to FIG. 1 to FIG. 9. FIG. 1 and FIG. 2 show a drying chamber 60 provided in a paint process line. More specifically, the drying chamber 60 includes a pair of side walls 41, 41 facing each other and a ceiling 42 mounted across the tops of these side walls 41, 41. A workpiece conveying system 11 (e.g., conveyor) is provided on the bottom surface inside the drying chamber 60 and on the extension thereof. This workpiece conveying system 11 conveys a workpiece 90 (e.g., car body) that has been painted in a transfer direction H so that the workpiece is carried into the drying chamber 60 from an entrance 61, passed through between the pair of side walls 41, 41, and carried out from an exit 62. Hereinafter, where the entrance 61 and exit 62 need not particularly be distinguished from each other, they will be referred to as inlet/outlet.

A hot air supply port (not shown) that supplies hot air into the drying chamber 60, and a hot air suction port (not shown) that sucks the hot air, are provided on the inner faces (e.g., opposite faces of the side walls 41, 41) of the drying chamber 60, these hot air supply port and hot air suction port being connected to a recirculation path 46 (see FIG. 1). A heating device 45 is provided midway through the recirculation path 46 to heat the air in the recirculation path 46, and a fan 47 circulatingly supplies the air heated by the heating device 45 into the drying chamber 60.

Figure 3:
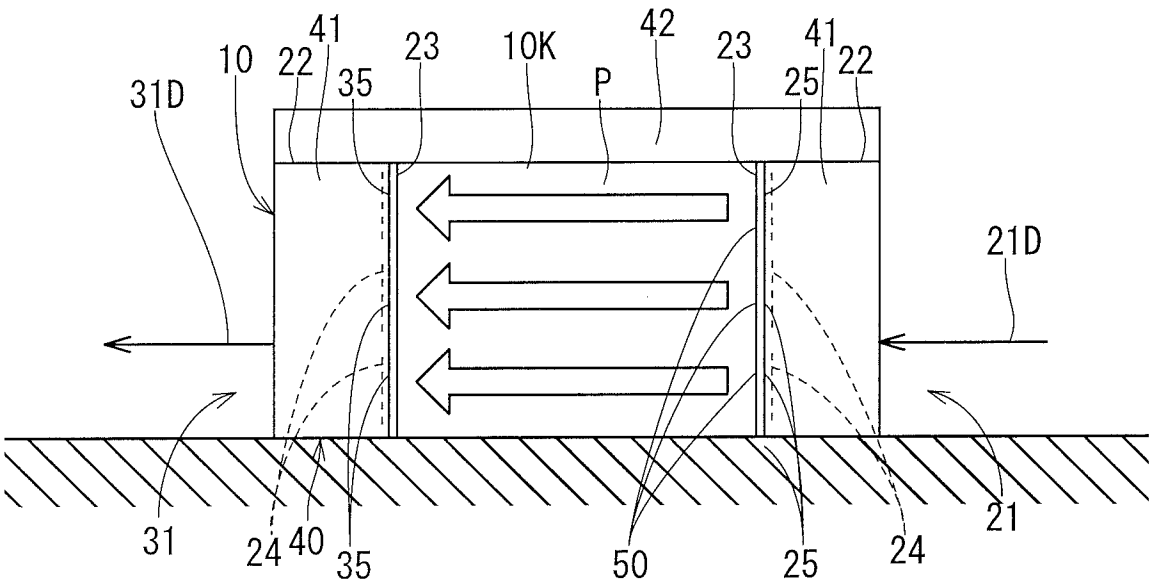
FIG. 3 is a conceptual diagram of the air curtain generating device.

As shown in FIG. 2, the air curtain generating device 10 that generates an air curtain P is provided at the inlet/outlet of the drying chamber 60 so that the inside and outside of the drying chamber 60 are divided by the air curtain P. As shown in FIG. 3, the air curtain generating device 10 includes a curtain starting device 21 and a curtain terminating device 31 being opposite each other in a lateral direction (in which the side walls 41, 41 face each other) on both sides of the inlet/outlet. The curtain starting device 21 and curtain terminating device 31 each includes a hollow box-shaped body 22 extending in an up and down direction and facing the inside of the drying chamber 60. More particularly, each box-shaped body 22 is provided in each side wall 41, and the inner side walls 23 of the box-shaped bodies 22 facing the inside of the drying chamber 60 are parallel to each other.

As shown in FIG. 3, the curtain starting device 21 includes a plurality of air jet units 25 aligned along the up and down direction. Similarly, the curtain terminating device 31 includes a plurality of air suction units 35 aligned along the up and down direction. Each of the air jet units 25 of the curtain starting device 21 and each of the air suction units 35 of the curtain terminating device 31 face each other in the lateral direction on both sides of the inlet/outlet. In this embodiment, the air curtain generating set 40 constituted of the curtain starting device 21 and the curtain terminating device 31 is provided with three pairs of the air jet unit 25 and the air suction unit 35 being laterally opposite each other, and the pairs being aligned along the up and down direction. Hereinafter, these three pairs will be separately referred to as, from the top, upper, middle, and lower pair, where applicable.

Figure 4A:
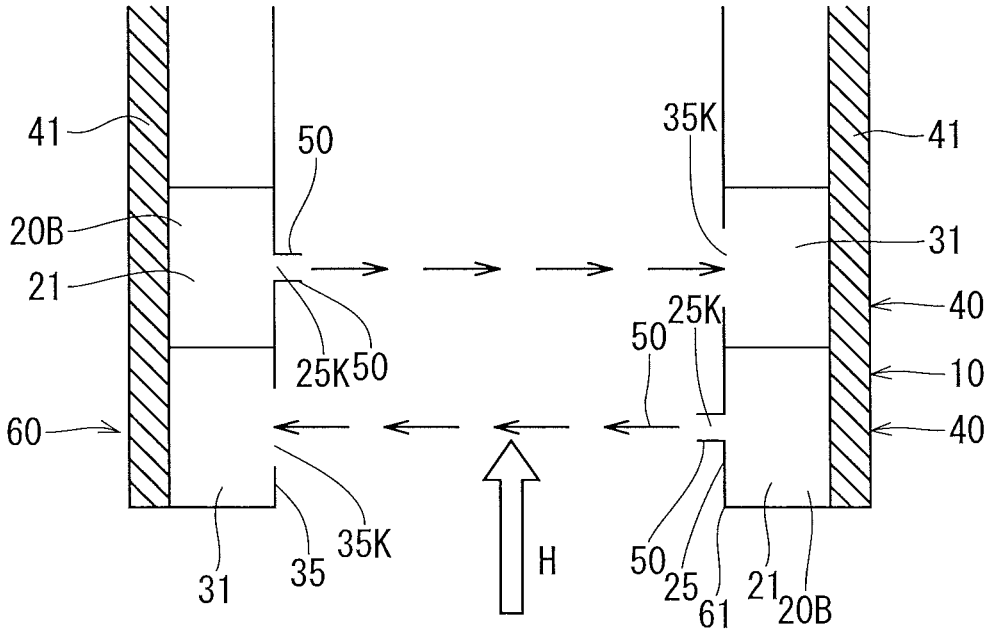
FIG. 4A is a cross-sectional plan view of air jet units and air suction units in a middle layer.
Figure 4B:
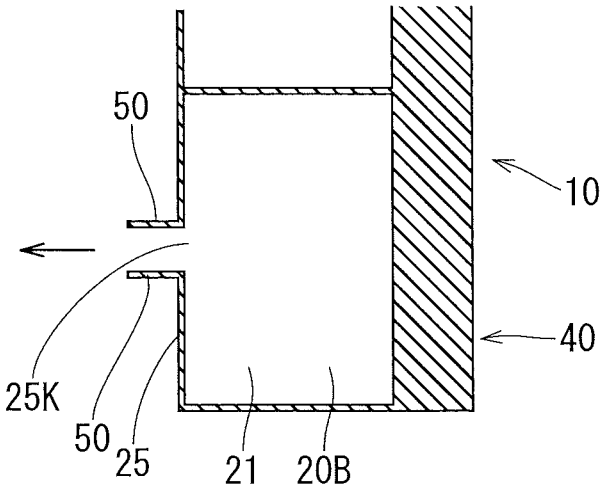
FIG. 4B is a plan view of air guides.
Figure 5:
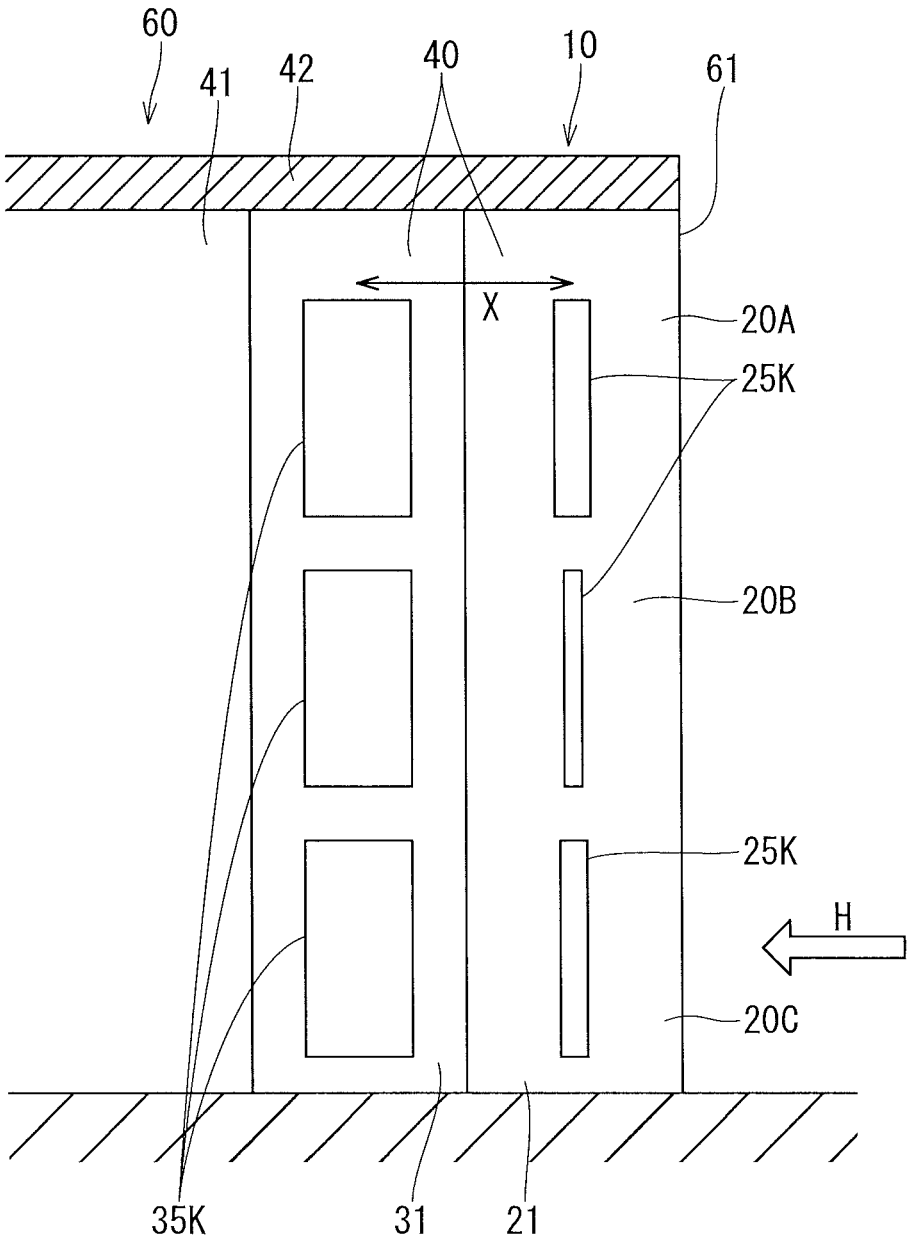
FIG. 5 is a cross-sectional side view of the air curtain generating device.

As shown in FIGS. 4A, 4B, and 5, a jet outlet 25K is provided for each air jet unit 25 in the inner side wall 23 of the curtain starting device 21. Air is ejected from the jet outlet 25K to generate the air curtain P. A suction port 35K is provided for each air suction unit 35 in the inner side wall 23 of the curtain terminating device 31. The air from the jet outlet 25K is sucked into the suction port 35K. In this embodiment, the jet outlets 25K and suction ports 35K are quadrate and elongated in the up and down direction. They have the same length and are equally spaced apart in the up and down direction. Note, the shape of the jet outlets 25K and suction ports 35K is not limited to quadrate. Also, the jet outlets 25K and suction ports 35K need not necessarily be equally spaced apart.

As shown in FIG. 3, an air feed duct 21D is connected to the box-shaped body 22 of the curtain starting device 21. The air fed by this air feed duct 21D is ejected from the air jet units 25 of the curtain starting device 21 along the lateral direction. A suction duct 31D is connected to the box-shaped body 22 of the curtain terminating device 31. The air from the air jet units 25 is sucked by this suction duct 31D through the air suction units 35 of the curtain terminating device 31. Thus, an air curtain P is generated between the air jet units 25 and the air suction units 35 being laterally opposite each other.

As shown in FIG. 1, the air feed duct 21D and suction duct 31D of the curtain starting device 21 and curtain terminating device 31 laterally opposite each other are communicated with each other and constitute an air return path 49, so that the air sucked from the air suction units 35 circulates through the air return paths 49 and is returned to the air jet units 25. A fan 49F is provided in the air return path 49, and this fan 49F delivers air to the air jet units 25 through the air feed duct 21D, and sucks air through the air suction units 35.

In this embodiment, a branch path 48 diverges from the air return path 49 and connects to the recirculation path 46 of the drying chamber 60, so that part of the air sucked by the air suction units 35 can be delivered to the drying chamber 60. In this embodiment, this branch path 48 enables the amount of air sucked from the air suction units 35 to be increased, and enables the amount of air sucked from the air suction units 35 to be larger than the amount of air ejected from the air jet units 25. This allows for the air from the air jet units 25 that has increased in volume by drawing the surrounding air to be sucked into the air suction units 35, which enables minimization of air leakage and heat escape from the drying chamber 60.

Figure 6A:
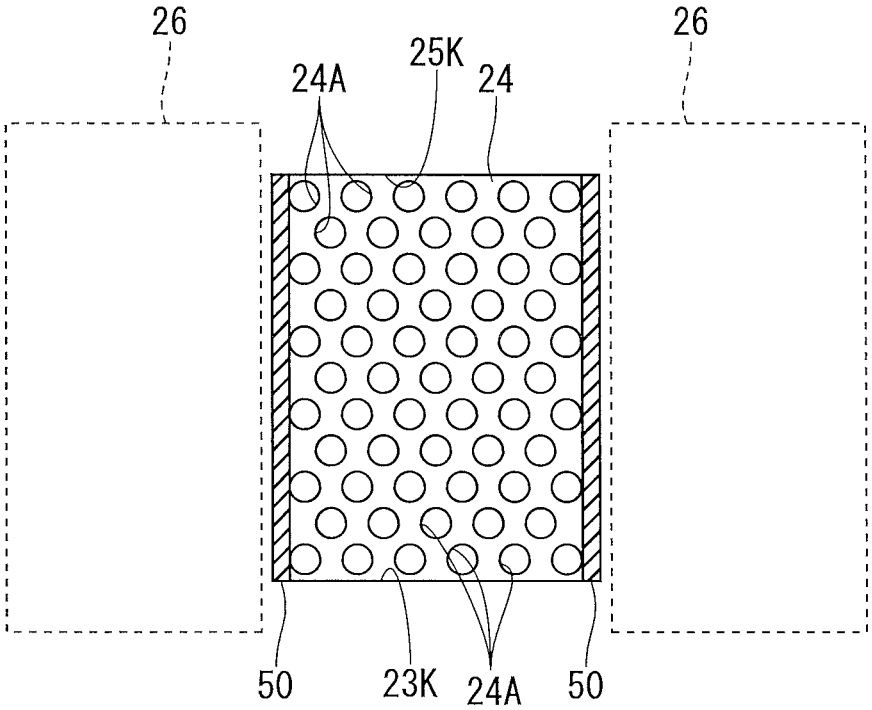
FIG. 6A is a front view of a jet outlet when shutters are set in a fully open position.
Figure 6B:
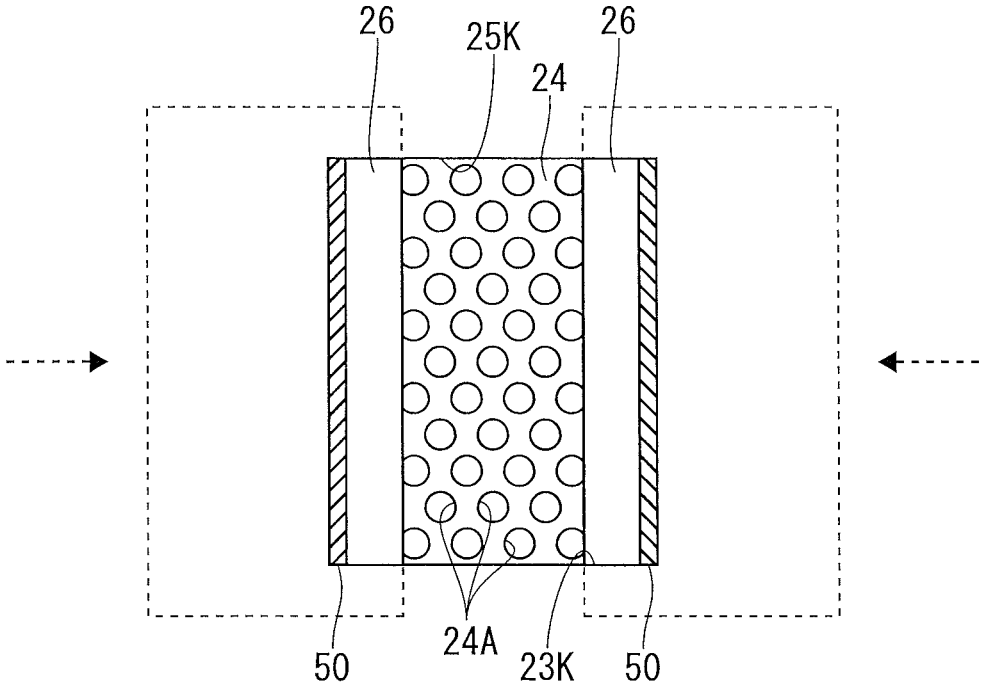
FIG. 6B is a front view of the jet outlet when the shutters are set between the fully open position and a fully closed position.

As shown in FIG. 6A and FIG. 6B, each air jet unit 25 is provided with an air constricting part for changing the amount of ejected air by constricting the area of the jet outlets 25K. More specifically, this air constricting part is made up of shutters 26 for constricting the area of the jet outlets 25K in the width direction (i.e., transfer direction H of the workpiece 90). More particularly, a pair of plate-like shutters 26 are provided and set on both outer sides in the lateral direction of open edges of a through hole 23K penetrating the inner side wall 23 of the box-shaped body 22. The pair of shutters 26, 26 are slidable along the transfer direction H of the workpiece 90, so that part of the aforementioned through hole 23K between the pair of shutters 26, 26 constitutes the jet outlet 25K. For example, the pair of shutters 26, 26 can be placed anywhere between a fully open position (FIG. 6A) where the jet outlet 25K is fully open and a fully closed position where the jet outlet 25K is shut. In this embodiment, the speed of air ejected from the jet outlet 25K can be adjusted by changing the positions of the shutters 26 (degree of constriction).

Likewise, each air suction unit 35 is provided with shutters 26, these shutters 26 constituting an air constricting part that changes the amount of air sucked from the suction port 35K. In this embodiment, accordingly, the speed of air sucked from the suction port 35K can also be adjusted by changing the positions of the shutters 26. The shutters 26 for each air suction unit 35 are placed at the fully open position in this embodiment.

In this embodiment, the shutters 26 are placed at different positions for each of the jet outlets 25K (i.e., jet outlets 25K have different degrees of constriction). More specifically, the size of the jet outlets 25K becomes smaller from the upper jet outlet 25K, lower jet outlet 25K, and middle jet outlet 25K, by being constricted by the shutters 26 in the width direction.

In this embodiment, of the pairs of air jet unit 25 and air suction unit 35, the lower pair 20C and middle pair 20B are located at a height where they are laterally aligned with the workpiece 90 as the workpiece 90 passes through the inlet/outlet. The upper pair 20A is located at a height where it is not laterally aligned with the workpiece 90 as the workpiece 90 passes through the inlet/outlet. Therefore, the air from the air jet units 25 of the lower pair 20C and the middle pair 20B is more prone to collide the workpiece 90 than the air from the air jet unit 25 of the upper pair 20A. When the air collides the workpiece 90, the air can more readily escape through the inlet/outlet of the drying chamber 60. In this embodiment, however, the jet outlets 25K of the lower and middle air jet units 25, where the air is prone to collide the workpiece 90, are constricted as described above, so that escape of the air from the drying chamber 60 through the inlet/outlet can be minimized. The ratio of the opening areas of the upper, middle, and lower jet outlets 25K (ratio of widths of the jet outlets 25K in this embodiment) should preferably be in the range of 1.0:0.3-0.7:0.5-1.0.

Figure 9:
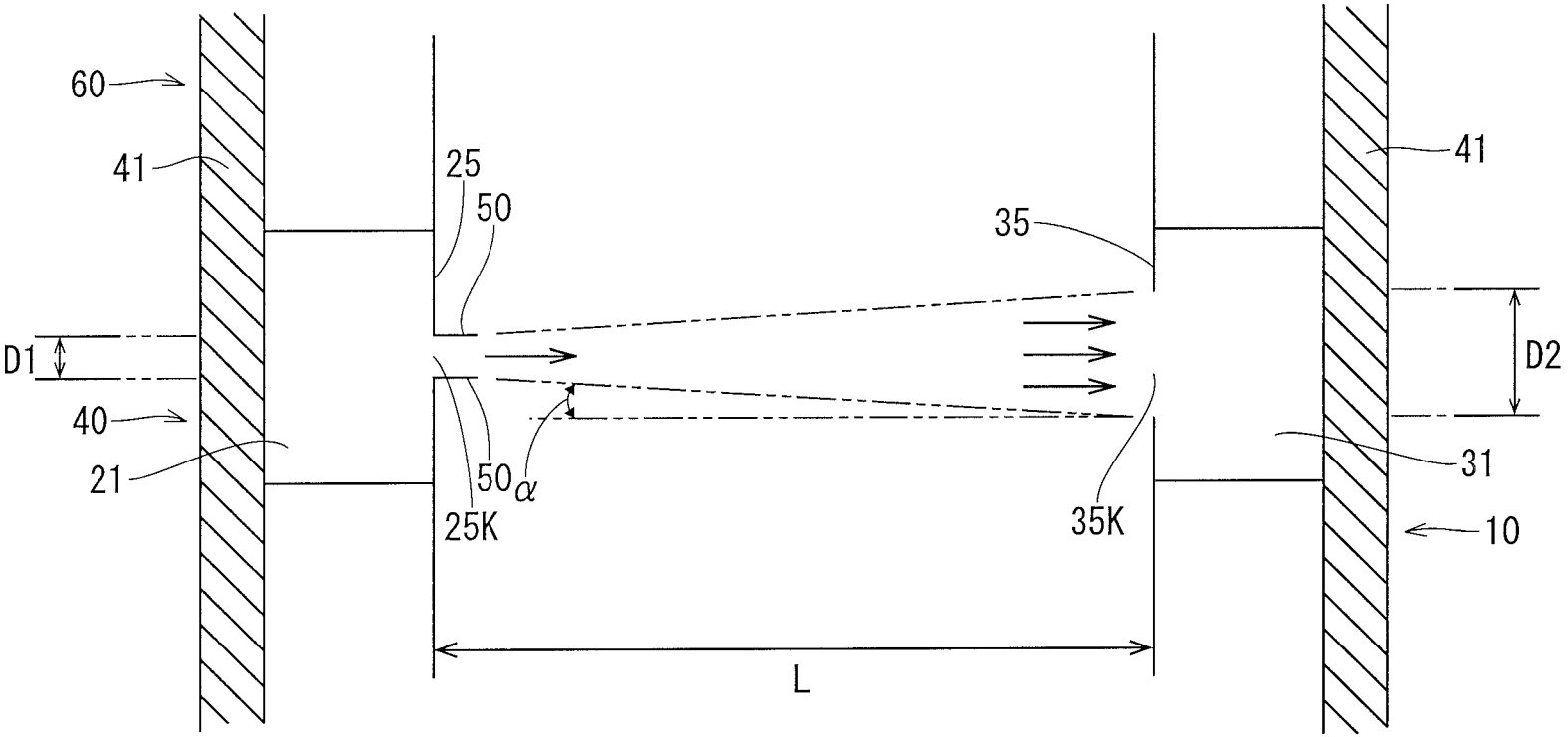
FIG. 9 is a cross-sectional plan view of an air curtain generating set.

The suction port 35K should preferably be larger than the jet outlet 25K as shown in FIG. 9. For example, the suction port 35K should preferably be formed to have such a size that its width D2 is in the range of divergent angles of 2 to 7° from the jet outlet 25K toward both sides respectively in the width direction of the jet outlet 25K (i.e., a in FIG. 9 being in the range of from 2 to 7°). In this embodiment, for example, the distance L between the jet outlet 25K and the suction port 35K is 1500 to 2000 mm, the width D1 of the jet outlet 25K is 50 to 150 mm, and the width D2 of the suction port 35K is 200 to 600 mm. These sizes of the jet outlet 25K and suction port 35K can easily be achieved by adjusting the positions of the shutters 26 described above.

In this embodiment, the jet outlet 25K and suction port 35K are covered by a permeable adjusting plate 24 from inside of the box-shaped body 22 (see FIGS. 3, 6A, and 6B). The adjusting plate 24 has a configuration wherein a plate-like member has multiple through holes 24A extending in the thickness direction, for example (e.g., punched metal). The amount of air ejected from the jet outlet 25K can be adjusted by changing the permeability of this adjusting plate 24 (e.g., by replacing the adjusting plate 24 with one that has a different total cross-sectional area of the through holes 24A), and the amount of air sucked from the suction port 35K can be adjusted, too.

The air curtain generating device 10 of this embodiment, as shown in FIG. 2 and FIG. 3, is provided with two air curtain generating sets 40 made up of the curtain starting device 21 and curtain terminating device 31 aligned along the passing-through direction of the inlet/outlet (i.e., transfer direction H), so that two layers of air curtains P, P are generated by these air curtain generating sets 40, 40. These air curtain generating sets 40, 40 are arranged such that the air flow directions of the air curtains P are opposite from each other. Namely, the curtain starting devices 21 and the curtain terminating devices 31 of the air curtain generating sets 40, 40 are arranged reversely in the lateral direction. One of the two air curtain generating sets 40, 40 placed on the outer side in the drying chamber 60 is located at the open edge of the inlet/outlet. In this embodiment, the upper, middle, and lower pairs of jet outlet 25K and suction port 35K laterally facing each other in both the air curtain generating sets 40, 40 are placed at the same heights.

Distance X in the passing-through direction of the inlet/outlet (transfer direction H) between the jet outlet 25K of the air jet unit 25 of one of the two air curtain generating sets 40, 40 and the suction port 35K of the air suction unit 35 of the other air curtain generating set 40 (more particularly, the distance X between centers of the jet outlet 25K and the suction port 35K, see FIG. 5) should preferably be 600 mm to 2000 mm. If the distance X is shorter than this range, the air from the jet outlet 25K of one air curtain generating set 40 is likely to be sucked into the suction port 35K of the other air curtain generating set 40 placed adjacent this jet outlet 25K, which will make efficient generation of air curtains P difficult. If the distance X is longer than the specified range, more space will be taken up by the two layers of air curtains P, P in the passing-through direction of the inlet/outlet, which will cause difficulties in achieving a size reduction. The amount of air ejected from the air jet units 25, or the amount of air sucked by the air suction units 35, may be differed between the two air curtain generating sets 40, 40 by changing the positions of the shutters 26 (degrees of constriction).

In this embodiment, the amount of ejected air for generating the air curtain P is reduced as the workpiece 90 passes across the air curtain P. More specifically, to execute this control, each of the air curtain generating devices 10 at the entrance 61 and the exit 62 is provided with an upstream sensor 61S and a downstream sensor 62S that detect passing of the workpiece 90 being conveyed by the workpiece conveying system 11 (corresponding to "workpiece detection sensor" in this disclosure) near upstream and downstream of the inlet/outlet in the transfer direction H (see FIG. 1). The detection results by these upstream sensor 61S and downstream sensor 62S are read by a controller 80 (corresponding to an "air control unit" in this disclosure, see FIG. 1).

When the upstream sensor 61S detects an approaching workpiece 90 conveyed thereto, the controller 80 lowers the number of revolution of the fan 49F corresponding to the three air jet units 25 at the time of the arrival of the workpiece 90 at the air curtain P. When the downstream sensor 62S detects the workpiece 90, the controller 80 restores the number of revolution of the fan 49F at the timing when the workpiece 90 leaves the air curtain P.

Since the controller 80 regulates the amount of air ejected from the air jet units 25 to be reduced when the workpiece 90 passes across the inlet/outlet as described above in this embodiment, the amount of air that collides the workpiece 90 after being ejected from the air jet units 25 is reduced, which can minimize air leakage from the drying chamber 60 through the inlet/outlet.

As shown in FIG. 4A and FIG. 4B, the air jet unit 25 is provided with air guides 50 that guide the air ejected from the jet outlets 25K. More specifically, the air guides 50 are plate-like members extending inward of the drying chamber 60 each from a pair of long sides being opposite each other in the width direction at the open edges of the jet outlets 25K. These pairs of air guides 50, 50 can turn around the pair of long sides of the jet outlets 25K as a rotation axis, to change the inclination angle with respect to the lateral direction of the drying chamber 60, as well as can be fixed at given or multiple positions within the range of the rotation. The pairs of air guides 50, 50 on both sides of the jet outlets 25K in this embodiment are parallel to each other.

In this embodiment, the air guides 50 of the air jet unit 25 of the middle pair 20B extend laterally (i.e., in the direction in which the air jet unit 25 and the air suction unit 35 face each other) as shown in FIG. 4B and guide the air from the jet outlet 25K in the lateral direction.

Figure 7A:
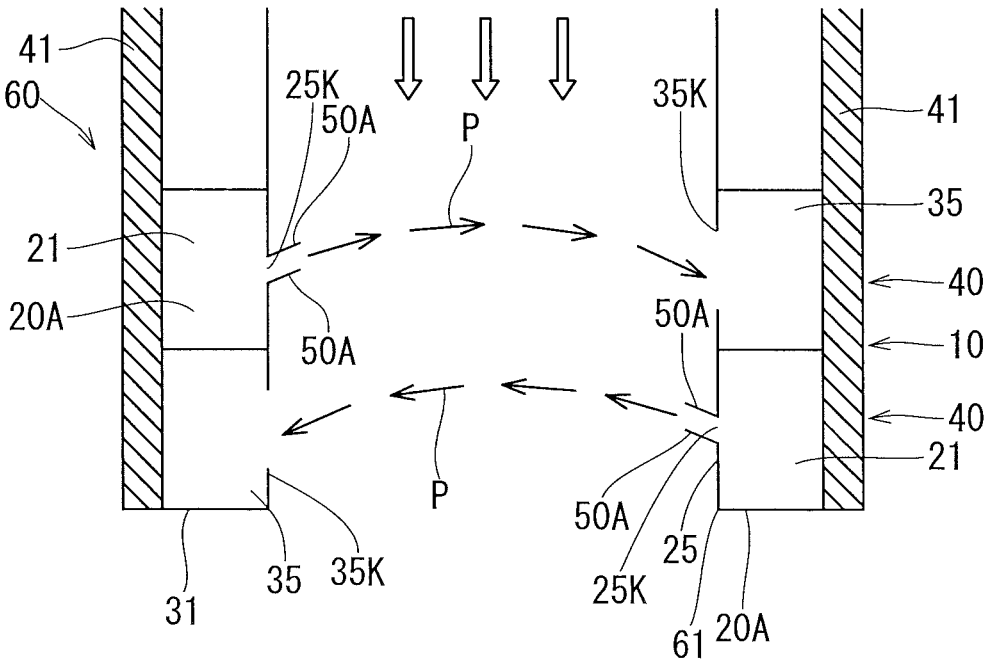
FIG. 7A is a cross-sectional plan view of air jet units and air suction units in an upper layer.
Figure 7B:
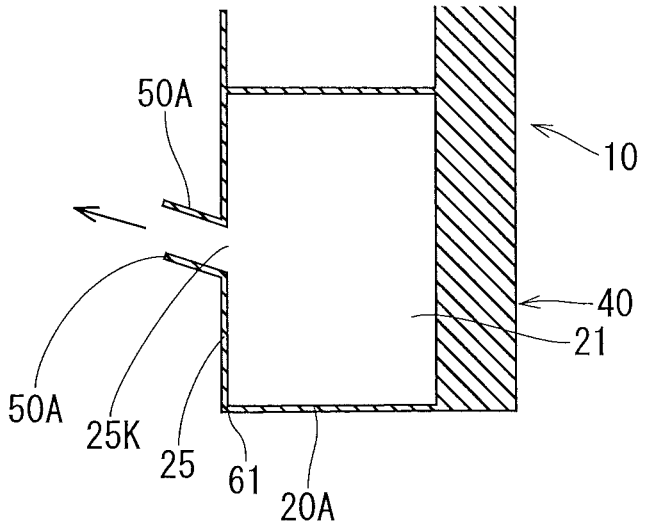
FIG. 7B is a plan view of first air guides.
Figure 8A:
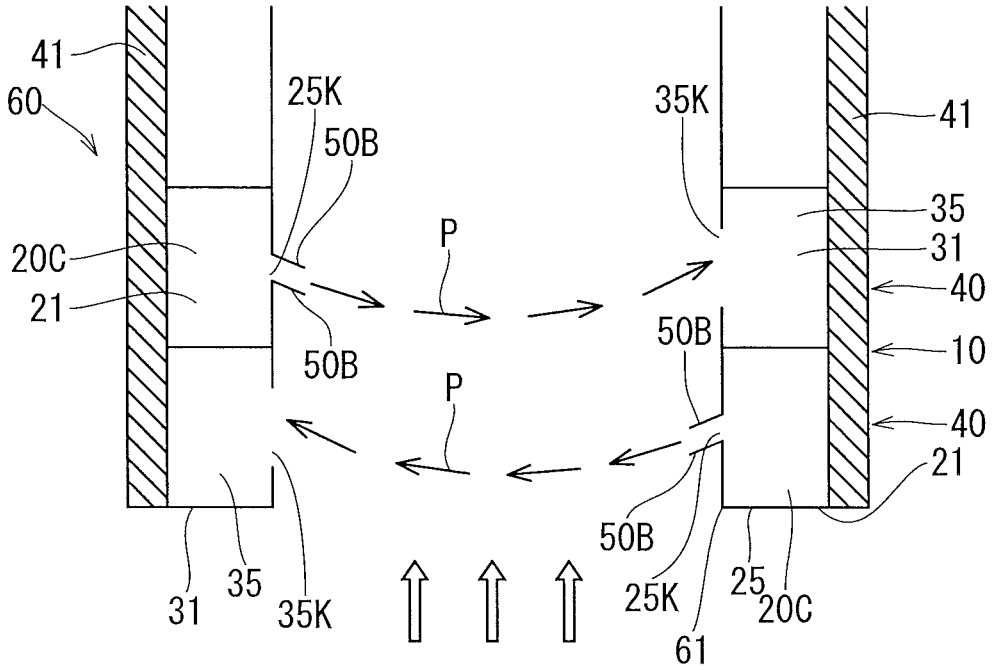
FIG. 8A is a cross-sectional plan view of air jet units and air suction units in a lower layer.
Figure 8B:
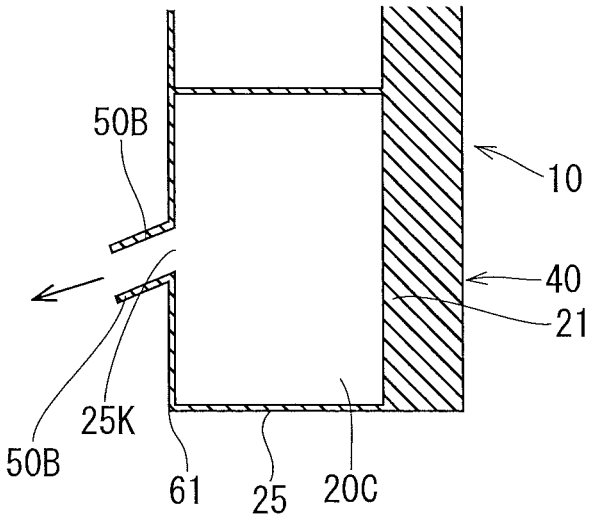
FIG. 8B is a plan view of second air guides.

In this embodiment, the air guides 50 of the air jet units 25 in an upper part of the inlet/outlet and of the air jet units 25 in a lower part of the inlet/outlet are inclined (e.g., at 10°) with respect to the lateral direction. More specifically, as shown in FIG. 7A and FIG. 7B, the air guides 50 of the air jet units 25 in the upper part of the inlet/outlet are first air guides 50A inclined inward of the drying chamber 60 relative to the lateral direction. Thus, the air from the air jet units 25 in the upper part is guided diagonally inward. As shown in FIG. 8A and FIG. 8B, the air guides 50 of the air jet units 25 in the lower part of the inlet/outlet are second air guides 50B inclined (e.g., at 10° outward of the drying chamber 60 relative to the lateral direction. Thus, the air from the air jet units 25 in the lower part is guided diagonally outward.

Since the first air guides 50A guide the air from the air jet units 25 in the upper part of the inlet/outlet of the drying chamber 60 diagonally inward of the drying chamber 60 relative to the lateral direction of the inlet/outlet in the air curtain generating device 10 of this embodiment, escape of the air from inside of the drying chamber 60 through the upper part of the inlet/outlet of the drying chamber 60 can be minimized. Since the second air guides 50B guide the air from the air jet units 25 in the lower part of the inlet/outlet of the drying chamber 60 diagonally outward of the drying chamber 60 relative to the lateral direction of the inlet/outlet, entrance of the air from outside of the drying chamber 60 through the lower part of the inlet/outlet of the drying chamber 60 can be minimized. The air coming in and out through the inlet/outlet of the drying chamber 60 can thus be suppressed according to this embodiment, so that the air blocking performance can be improved. This consequently allows for improvement of drying efficiency of the drying chamber.

It is assumed that the air in the upper part of the drying chamber 60 is prone to escape through the inlet/outlet to the outside of the drying chamber 60 (see thick arrows in FIG. 7A), while, in the drying chamber 60, air can readily enter into the lower part of the drying chamber 60 from outside of the drying chamber 60 through the inlet/outlet (see thick arrows in FIG. 8A) due to the temperature typically being higher in the upper part than in the lower part of the drying chamber 60. Such air flows in and out of the air curtain generating device 10 can be effectively suppressed by the first air guides 50A and second air guides 50B according to this embodiment.

Moreover, since the jet outlets 25K of the air jet units 25 in the upper part and lower part at the inlet/outlet where air can more readily come in and out through the inlet/outlet are open larger than those of the middle part of the inlet/outlet, the air flows coming in and out through the inlet/outlet can be suppressed efficiently according to this embodiment.

In this embodiment, both the air jet unit 25 and the air suction unit 35 are mixedly provided at the open edges on one side and the other side in the lateral direction of the inlet/outlet. Namely, since the air jet units 25 are provided on both of one side and the other side in the lateral direction of the inlet/outlet, it is prevented that the air curtain P disappears on one side or the other side in the lateral direction when an object passes through the inlet/outlet and passes across the air curtain P. Moreover, since the two layers of air curtains P, P aligned along the passing-through direction of the inlet/outlet have air flows in opposite directions in this embodiment, an unbalance of disappearing parts of the air curtains P between one side and the other side in the lateral direction can be minimized when an object passes through the air curtains P.

OTHER EMBODIMENTS (1) In the embodiment described above, the air curtain generating device 10 may be placed only at the entrance 61, or only at the exit 62, or both at the entrance 61 and the exit 62, of the drying chamber 60.

Figure 10:
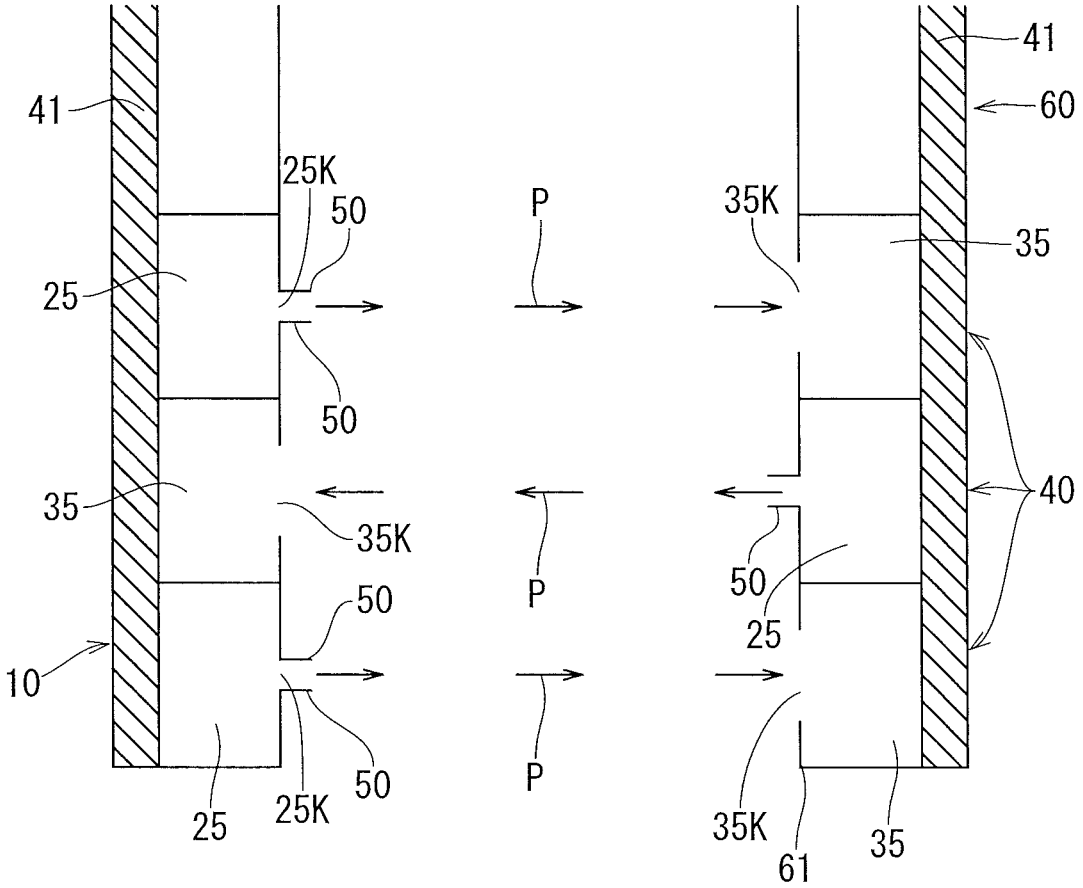
FIG. 10 is a cross-sectional plan view of an air curtain generating device according to another embodiment.
Figure 11:
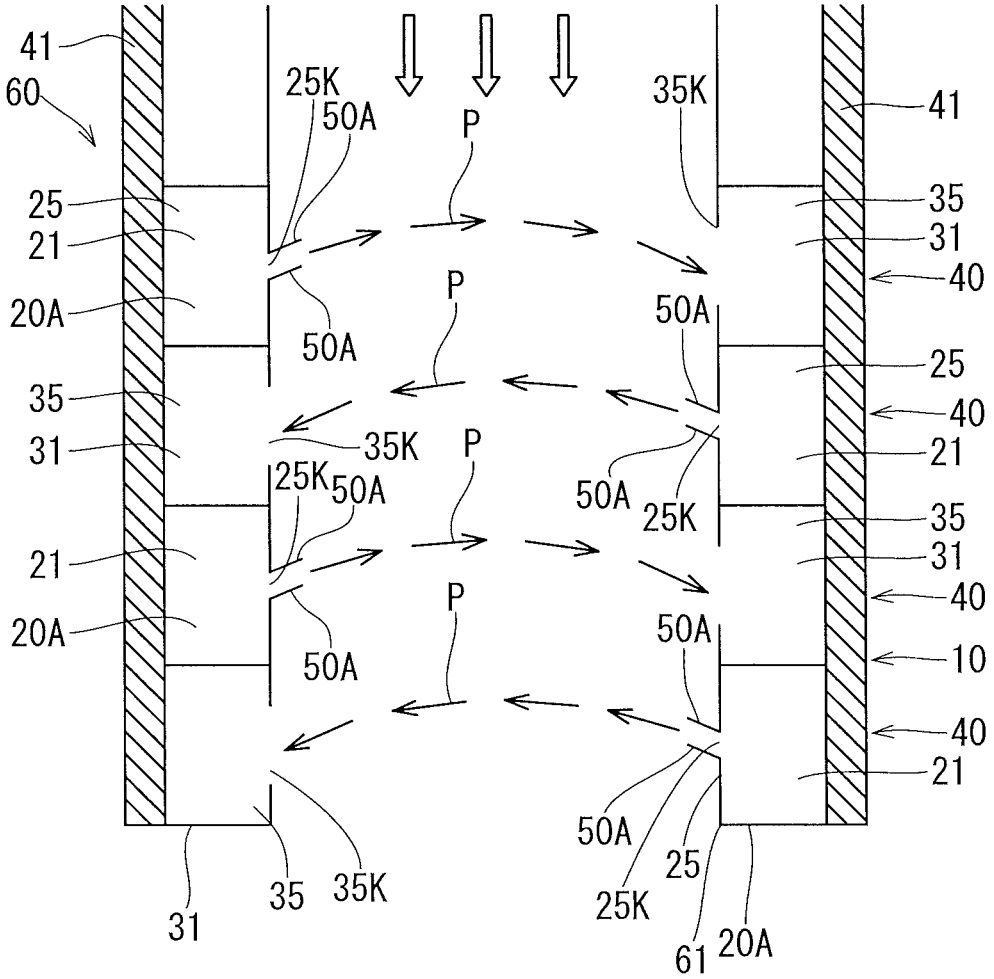
FIG. 11 is a cross-sectional plan view of an air curtain generating device according to yet another embodiment.

(2) In the embodiment described above, three or more air curtain generating sets may be aligned along the passing through direction of the inlet/outlet (transfer direction H of the workpiece 90) to generate three or more layers of air curtains P. In this case, the adjacent air curtain generating sets 40, 40 should preferably be placed reversely so that the air flows of these air curtains P are alternately opposite, as shown in FIG. 10 and FIG. 11. With this configuration, an unbalance of disappearing parts of the air curtains P between one side and the other side in the lateral direction can be minimized when an object passes through the air curtains P. Among the configurations equipped with such multiple layers of air curtain generating sets 40, those with two to four air curtain generating sets 40 aligned at the inlet/outlet are preferable, and the three-layer structure (see FIG. 10) is particularly preferable, from the viewpoints of compactness, air blocking performance, and cost.

(3) In section (2) above, the second air guides 50B may be tilted at the same inclination angle relative to the lateral direction in the multiple air curtain generating sets 40 at the entrance 61, or, as shown in FIG. 11, the first air guides 50A may be tilted at the same inclination angle relative to the lateral direction. Such configuration may also be applied to the multiple air curtain generating sets 40 at the exit 62.

Figure 12:
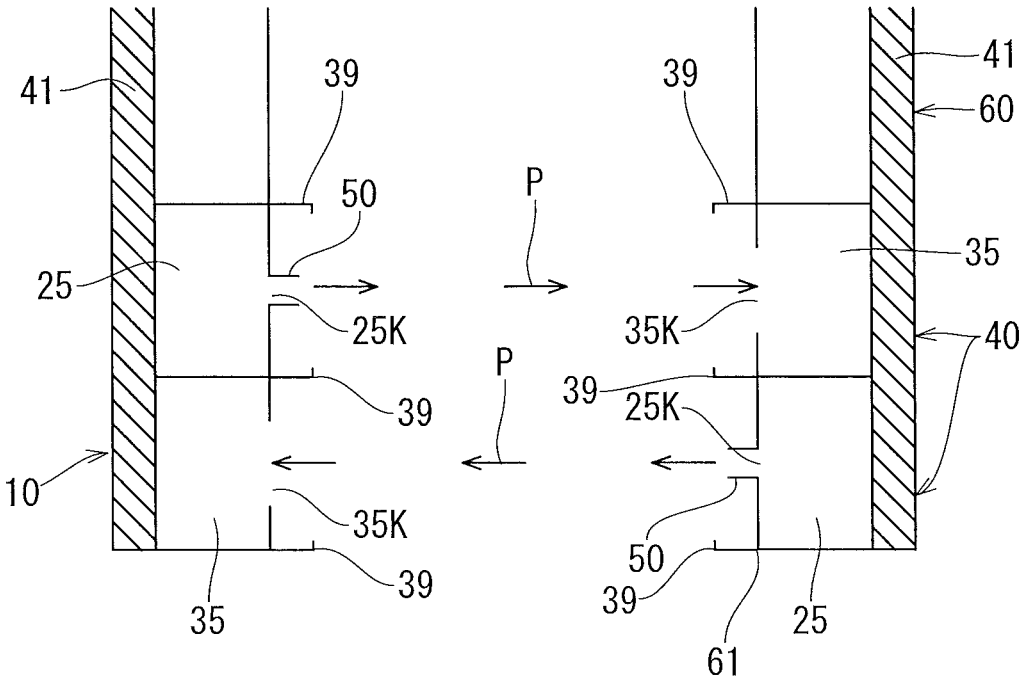
FIG. 12 is a cross-sectional plan view of an air curtain generating device according to yet another embodiment.

(4) As shown in FIG. 12, partition plates 39 may be provided on both sides of the air suction units 35 in an aligning direction of the plurality of the pairs of the air jet unit 25 and the air suction unit 35 laterally opposite each other (e.g., in the up and down direction or the transfer direction H) to divide the air suction units 35 from the adjacent air jet units 25. With this configuration, the partition plates 39 can serve as flow regulator plates that regulate the air sucked into the air suction units 35, which allows for smooth air suction. When this configuration is applied to the embodiment described above, the partition plates 39 should protrude from the inner side walls 23 of the box-shaped body 22 preferably in a range of from 50 mm to 200 mm in length.

Figure 13A:
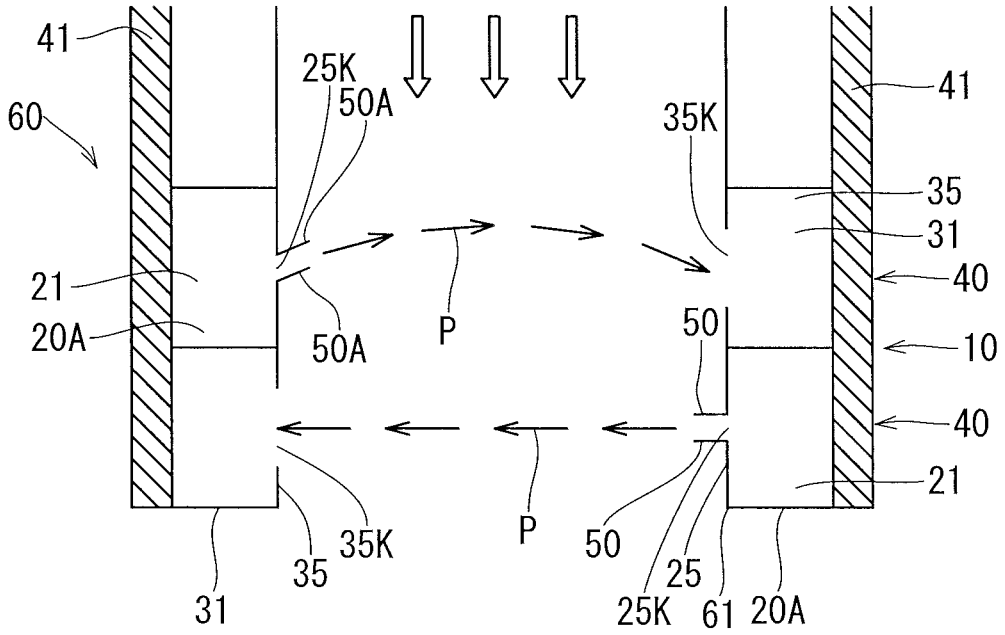
FIG. 13A is a cross-sectional plan view of an air curtain generating device according to another embodiment.
Figure 13B:
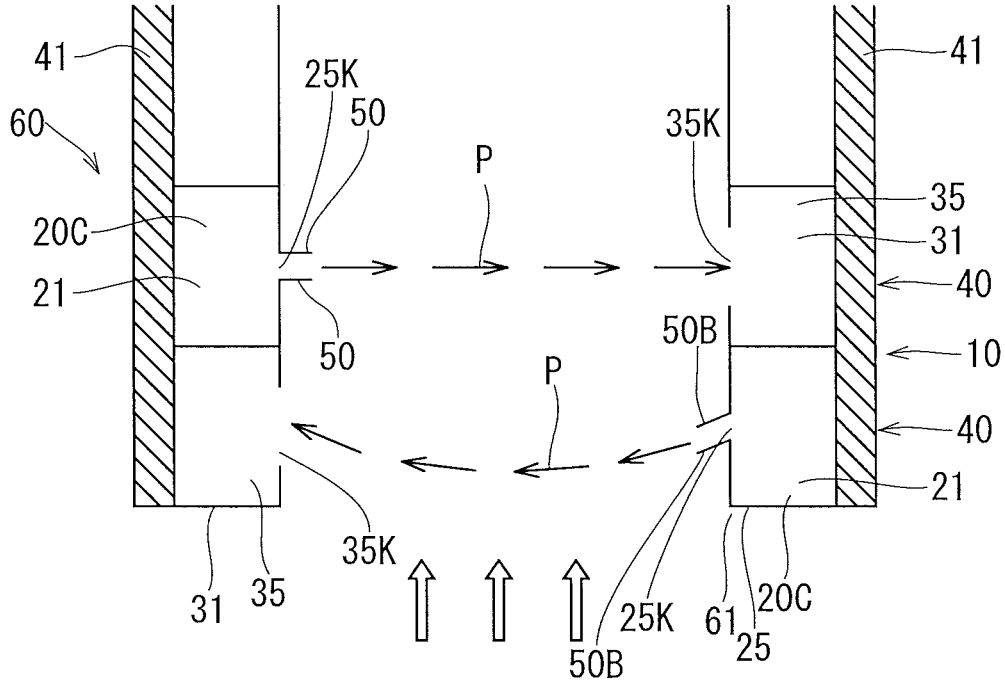
FIG. 13B is a cross-sectional plan view of an air curtain generating device according to another embodiment.

(5) In the embodiment described above, the inclination angle of the first air guides 50A relative to the lateral direction is the same in all the air curtain generating sets 40, and the inclination angle of the second air guides 50B relative to the lateral direction is the same in all the air curtain generating sets 40. Instead, the inclination angle of the first air guides 50A relative to the lateral direction may be different among the air curtain generating sets 40, and the inclination angle of the second air guides 50B relative to the lateral direction may be different among the air curtain generating sets 40. The first air guides 50A may be provided only to the innermost air curtain generating set 40 of the multiple layers of air curtain generating sets 40, and the second air guides 50B may be provided only to the outermost air curtain generating set 40 of the multiple layers of air curtain generating sets 40, as shown respectively in FIG. 13A and FIG. 13B.

(6) In the configuration wherein multiple pairs of air jet unit 25 and air suction unit 35 laterally opposite each other are aligned in the up and down direction, these pairs may be placed such that the air flows are alternately opposite. Namely, in this configuration, the air jet units 25 and air suction units 35 are alternately arranged (mixedly provided) at the open edges on one side and the other side in the lateral direction of the inlet/outlet.

(7) In the embodiment described above, the pair of air guides 50, 50 opposite each other on both sides of the jet outlet 25K may be arranged parallel, or may be placed such that the space between them is reduced, or increased, as separating from the inner side wall 23.

Figure 14A:
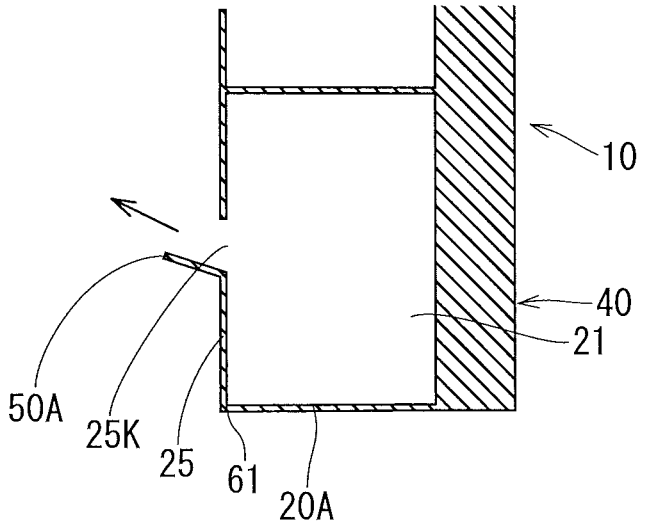
FIG. 14A is a cross-sectional plan view of a first air guide according to another embodiment.

(8) While one pair of the first air guides 50A is provided on both sides of the jet outlet 25K in the embodiment described above, the first air guide 50A may be provided only on one side. In this case, the first air guides 50A may be provided on one side of the jet outlet 25K away from a central part of the drying chamber 60, as shown in FIG. 14A.

Figure 14B:
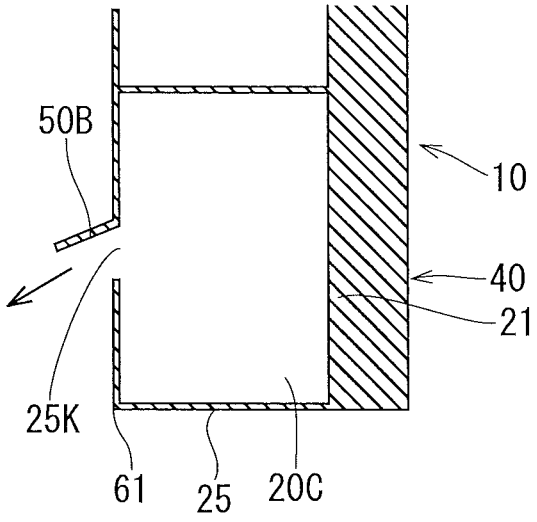
FIG. 14B is a cross-sectional plan view of a second air guide according to another embodiment.

(9) While one pair of the second air guides 50B is provided on both sides of the jet outlet 25K in the embodiment described above, the second air guide 50B may be provided only on one side. In this case, the second air guides 50B may be provided on one side of the jet outlet 25K closer to the central part of the drying chamber 60, as shown in FIG. 14B.

(10) The air curtain generating device 10 may be applied to an inlet/outlet of a preheat booth for heating the workpiece prior to painting, instead of the inlet/outlet of the drying chamber 60.

(11) In the embodiment described above, the air curtain generating device 10 may be configured such that only one of the first air guides 50A and the second air guides 50B is provided. Namely, the upper air jet units 25 may be provided with the air guides 50 parallel to the lateral direction, instead of the first air guides 50A. The lower air jet units 25 may be provided with the air guides 50 parallel to the lateral direction, instead of the second air guides 50B. These configurations also cause less air to come into and out of the drying chamber 60 through the inlet/outlet, so that the drying efficiency can be improved.

(12) In the embodiment described above, the positions of the air jet units 25 provided with the first air guides 50A and second air guides 50B may be changed as required in accordance with the flows of air coming in and out of the drying chamber 60 through the inlet/outlet. For example, while the first air guides 50A are provided only to the air jet units 25 in the upper part of the inlet/outlet in the embodiment described above, the first air guides 50A may be provided to the air jet units 25 in the middle part or the lower part in the up and down direction of the inlet/outlet. Similarly, the second air guides 50B may be provided to the air jet units 25 in the middle part or the upper part in the up and down direction of the inlet/outlet, for example.

(13) In the embodiment described above, the upper, middle, and lower jet outlets 25K may have the same size (same degree of constriction of the shutters 26). Also, the upper, middle, and lower suction ports 35K may have the same size (same degree of constriction of the shutters 26).

What is claimed is:

1. An air curtain generating device comprising:

a plurality of pairs of an air jet unit and an air suction unit placed opposite each other on both sides in a lateral direction of an inlet/outlet of a drying chamber, the plurality of the pairs being aligned up and down, the air suction units sucking air ejected from the air jet units to generate an air curtain;

a first air guide provided to the air jet units in an upper part of the inlet/outlet to guide air ejected from each of the air jet units in the upper part of the inlet/outlet in a direction inclined inward of the drying chamber relative to the lateral direction of the inlet/outlet; and a second air guide provided to the air jet units in a lower part of the inlet/outlet to guide air ejected from each of the air jet units in the lower part of the inlet/outlet in a direction inclined outward of the drying chamber relative to the lateral direction of the inlet/outlet.

2. The air curtain generating device according to claim 1, wherein either one of the air jet units and the air suction units is provided with an air constricting part to make an amount of ejected air or an amount of sucked air different among the plurality of the pairs of the air jet unit and the air suction unit.

3. The air curtain generating device according to claim 2, wherein a plurality of air curtain generating sets are provided in multiple layers along a passing-through direction of the inlet/outlet, each air curtain generating set comprising the plurality of pairs of the air jet unit and the air suction unit aligned up and down to generate multiple layers of the air curtains along the passing-through direction of the inlet/outlet, and the air jet units of one of the air curtain generating sets adjacent each other and the air jet units an other air curtain generating set are respectively placed on one side and an other side in the lateral direction of the inlet/outlet so that air flows of the multiple layers of the air curtains are oriented alternately opposite from each other.

4. The air curtain generating device according to claim 2, wherein the air jet units and the air suction units are mixedly provided on one side and an other side in the lateral direction of the inlet/outlet.

5. The air curtain generating device according to claim 2, further comprising:

a workpiece conveying system that conveys a workpiece to the drying chamber through the inlet/outlet;

a workpiece detection sensor to detect that the workpiece has reached the inlet/outlet; and an air control unit to change an amount of air ejected from the air jet units based on detection results of the workpiece detection sensor.

6. The air curtain generating device according to claim 1, wherein the air jet units and the air suction units are mixedly provided at open edges of one side and an other side in the lateral direction of the inlet/outlet.

7. The air curtain generating device according to claim 1, wherein a plurality of air curtain generating sets are provided in multiple layers along a passing-through direction of the inlet/outlet, each air curtain generating set comprising the plurality of the pairs of the air jet unit and the air suction unit aligned up and down to generate multiple layers of the air curtains along the passing-through direction of the inlet/outlet, and the air jet units of one of the air curtain generating sets adjacent each other and the air jet units of an other air curtain generating set are respectively placed on one side and an other side in the lateral direction of the inlet/outlet so that air flows of the multiple layers of the air curtains are oriented alternately opposite from each other.

8. The air curtain generating device according to claim 7, wherein the first air guides have an identical inclination angle relative to the lateral direction of the inlet/outlet in the multiple layers of the air curtain generating sets, and the second air guides have an identical inclination angle relative to the lateral direction of the inlet/outlet in the multiple layers of the air curtain generating sets.

9. The air curtain generating device according to claim 7, wherein the first air guides are provided only to an innermost air curtain generating set of the multiple layers of the air curtain generating sets, and the second air guides are provided only to an outermost air curtain generating set of the multiple layers of the air curtain generating sets.

10. The air curtain generating device according to claim 7, wherein either one of the air jet units and the air suction units is provided with an air constricting part to make an amount of ejected air or an amount of sucked air different among the air curtain generating sets.

11. The air curtain generating device according to claim 7, wherein the plurality of pairs of the air jet unit and the air suction unit are spaced apart in a range of from 600 mm to 2000 mm in the passing-through direction.

12. The air curtain generating device according to claim 7, wherein partition plates are provided on both sides of the air suction units to divide the air suction units and the air jet units in the passing-through direction.

13. The air curtain generating device according to claim 7, further comprising:

a workpiece conveying system that conveys a workpiece to the drying chamber through the inlet/outlet;

a workpiece detection sensor to detect that the workpiece has reached the inlet/outlet; and an air control unit to change an amount of air ejected from the air jet units based on detection results of the workpiece detection sensor.

14. The air curtain generating device according to claim 7, further comprising an air return path to deliver air back to the air jet units from the air suction units; and a branch path diverging from the air return path to deliver air inside the air return path to the drying chamber.

15. The air curtain generating device according to claim 1, wherein the air jet units and the air suction units are mixedly provided on one side and an other side in the lateral direction of the inlet/outlet.

16. The air curtain generating device according to claim 15, wherein partition plates are provided on both sides of the air suction units to divide the air suction units and the air jet units in an aligning direction of the plurality of the pairs.

17. The air curtain generating device according to claim 1, wherein the plurality of pairs of the air jet unit and the air suction unit are spaced apart in a range of from 600 mm to 2000 mm.

18. The air curtain generating device according to claim 1, wherein partition plates are provided on both sides of the air suction units to divide the air suction units and the air jet units in an aligning direction of the plurality of the pairs.

19. The air curtain generating device according to claim 1, further comprising:

a workpiece conveying system that conveys a workpiece to the drying chamber through the inlet/outlet;

a workpiece detection sensor to detect that the workpiece has reached the inlet/outlet; and an air control unit to change an amount of air ejected from the air jet units based on detection results of the workpiece detection sensor.

20. The air curtain generating device according to claim 1, further comprising an air return path to deliver air back to the air jet units from the air suction units; and a branch path diverging from the air return path to deliver air inside the air return path to the drying chamber.

21. An air curtain generating device comprising:

a plurality of pairs of an air jet unit and an air suction unit placed opposite each other on both sides in a lateral direction of an inlet/outlet of a drying chamber, the plurality of the pairs being aligned up and down, the air suction units sucking air ejected from the air jet units to generate an air curtain;

a first air guide provided to the air jet units in an upper part of the inlet/outlet to guide air ejected from the air jet units in a direction inclined inward of the drying chamber relative to the lateral direction of the inlet/outlet; and a second air guide provided to the air jet units in a lower part of the inlet/outlet to guide air ejected from the air jet units in a direction inclined outward of the drying chamber relative to the lateral direction of the inlet/outlet, wherein:

a plurality of air curtain generating sets are provided in multiple layers along a passing-through direction of the inlet/outlet, each air curtain generating set comprising the plurality of the pairs of the air jet unit and the air suction unit aligned up and down to generate multiple layers of the air curtains along the passing-through direction of the inlet/outlet, the air jet units of one of the air curtain generating sets adjacent each other and the air jet units of an other air curtain generating set are respectively placed on one side and an other side in the lateral direction of the inlet/outlet so that air flows of the multiple layers of the air curtains are oriented alternately opposite from each other, the first air guides are provided only to an innermost air curtain generating set of the multiple layers of the air curtain generating sets, and the second air guides are provided only to an outermost air curtain generating set of the multiple layers of the air curtain generating sets.

22. An air curtain generating device comprising:

a plurality of pairs of an air jet unit and an air suction unit placed opposite each other on both sides in a lateral direction of an inlet/outlet of a drying chamber, the plurality of the pairs being aligned up and down, the air suction units sucking air ejected from the air jet units to generate an air curtain;

a first air guide provided to the air jet units in an upper part of the inlet/outlet to guide air ejected from the air jet units in a direction inclined inward of the drying chamber relative to the lateral direction of the inlet/outlet; and a second air guide provided to the air jet units in a lower part of the inlet/outlet to guide air ejected from the air jet units in a direction inclined outward of the drying chamber relative to the lateral direction of the inlet/outlet, wherein:

a plurality of air curtain generating sets are provided in multiple layers along a passing-through direction of the inlet/outlet, each air curtain generating set comprising the plurality of the pairs of the air jet unit and the air suction unit aligned up and down to generate multiple layers of the air curtains along the passing-through direction of the inlet/outlet, the air jet units of one of the air curtain generating sets adjacent each other and the air jet units of an other air curtain generating set are respectively placed on one side and an other side in the lateral direction of the inlet/outlet so that air flows of the multiple layers of the air curtains are oriented alternately opposite from each other, and the plurality of pairs of the air jet unit and the air suction unit are spaced apart in a range of from 600 mm to 2000 mm in the passing-through direction.

* * * * *